US009874409B2

(12) United States Patent
Ito

(10) Patent No.: US 9,874,409 B2
(45) Date of Patent: Jan. 23, 2018

(54) PLATE HEAT EXCHANGER AND HEAT PUMP APPARATUS

(75) Inventor: Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 768 days.

(21) Appl. No.: 14/131,693

(22) PCT Filed: Jul. 13, 2011

(86) PCT No.: PCT/JP2011/065932
§ 371 (c)(1),
(2), (4) Date: Feb. 19, 2014

(87) PCT Pub. No.: WO2013/008320
PCT Pub. Date: Jan. 17, 2013

(65) Prior Publication Data
US 2014/0182322 A1 Jul. 3, 2014

(51) Int. Cl.
*F28F 3/08* (2006.01)
*F28F 3/04* (2006.01)
(Continued)

(52) U.S. Cl.
CPC ..... *F28F 3/08* (2013.01); *F25B 30/02* (2013.01); *F28D 9/005* (2013.01); *F28F 3/046* (2013.01); *F28F 9/026* (2013.01); *F28F 2265/14* (2013.01)

(58) Field of Classification Search
CPC ..... F28F 3/046; F28F 3/08; F28F 3/00; F28F 3/083; F28F 3/04; F28F 3/086;
(Continued)

(56) References Cited

U.S. PATENT DOCUMENTS 4,989,626 A 2/1991 Takagi et al.
6,131,648 A 10/2000 Rasmussen
(Continued)

FOREIGN PATENT DOCUMENTS

EP 1475596 A2 11/2004
JP 02-134480 A 5/1990
(Continued)

OTHER PUBLICATIONS

Office Action dated Mar. 23, 2015 issued in corresponding CN patent application No. 201180072256.8.
(Continued)

*Primary Examiner* — Grant Moubry
*Assistant Examiner* — Harry Arant
(74) *Attorney, Agent, or Firm* — Posz Law Group, PLC

(57) ABSTRACT

Heat transfer plates each include, in a portion thereof forming a heat-exchanging passage, a corrugated portion including a plurality of top parts and a plurality of bottom parts provided alternately from a side thereof having a first inlet toward a side thereof having a first outlet. The heat transfer plate also includes a corrugated portion connected to the corrugated portion, the corrugated portion being provided on a side of a second inlet that faces the heat-exchanging passage. The top parts of the corrugated portion and the top parts of the corrugated portion each have a planar shape. The top parts of the corrugated portion has a larger width than the top parts of the corrugated portion in a direction perpendicular to ridges of the corrugated portions.

12 Claims, 20 Drawing Sheets

(51) Int. Cl.

| | |
|---|---|
| ***F28F 9/02*** | (2006.01) |
| ***F28D 9/00*** | (2006.01) |
| ***F25B 30/02*** | (2006.01) |

(58) Field of Classification Search
CPC .... F28F 3/048; F28F 2275/04; F28F 2225/00; F28F 2225/04; F28D 9/00; F28D 9/005
See application file for complete search history.

(56) References Cited

U.S. PATENT DOCUMENTS

| | | | | |
|---|---|---|---|---|
| 6,394,178 | B1 | 5/2002 | Yoshida et al. | |
| 2008/0029257 | A1 | 2/2008 | Nilsson | |
| 2008/0210414 | A1 | 9/2008 | Blomgren et al. | |
| 2008/0223564 | A1* | 9/2008 | Bjornsson | F28D 9/005 165/167 |
| 2009/0044928 | A1 | 2/2009 | Upadhya et al. | |
| 2009/0178793 | A1 | 7/2009 | Larsson et al. | |
| 2010/0065262 | A1* | 3/2010 | Platt | F28D 9/005 165/164 |

FOREIGN PATENT DOCUMENTS

| | | | |
|---|---|---|---|
| JP | 11-248392 | A | 9/1999 |
| JP | 3285243 | B | 5/2002 |
| JP | 2008-511811 | A | 4/2008 |
| JP | 2009-500588 | A | 1/2009 |
| JP | 2009-521658 | A | 6/2009 |
| JP | 2009-170877 | A | 7/2009 |
| WO | 2005-088221 | A1 | 9/2005 |
| WO | 2007-142592 | A1 | 12/2007 |

OTHER PUBLICATIONS

Office Action dated Dec. 2, 2014 issued in corresponding JP patent application No. 2013-523743 (and English translation).
International Search Report of the International Searching Authority dated Oct. 25, 2011 for the corresponding international application No. PCT/JP2011/065932 (English translation attached).
Extended European Search Report dated Apr. 24, 2015 in the corresponding European Patent Application No. 11869406.6.
Office Action dated Nov. 3, 2017 issued in corresponding EP patent application No. 11 869 406.6.

* cited by examiner

PLATE HEAT EXCHANGER AND HEAT PUMP APPARATUS

CROSS REFERENCE TO RELATED APPLICATION

This application is a U.S. national stage application of PCT/JP2011/065932 filed on Jul. 13, 2011, the contents of which are incorporated herein by reference.

TECHNICAL FIELD

The present invention relates to a plate heat exchanger including a stack of a plurality of heat transfer plates.

BACKGROUND

A known plate heat exchanger includes a stack of substantially rectangular plates each having passage holes provided at four corners thereof, and passages in which water flows and passages in which a refrigerant flows that are formed between adjacent ones of the plates and alternately in a stacking direction, the passage holes functioning as inlets and outlets for the water and the refrigerant (see Patent Literature 1). In the plate heat exchanger, the water passages are closed near the passage holes that function as the inlet and the outlet for the refrigerant.

PATENT LITERATURE

Patent Literature 1: Japanese Unexamined Patent Application Publication (Translation of PCT Application) No. 2009-500588

If the plate heat exchanger is used as an evaporator, the water may freeze in the plate heat exchanger. When water freezes, it expands by about 9%. For example, if the water freezes in a central part of a water passage or near a passage hole functioning as a water inlet or outlet, some spaces that allow the water to expand are provided in peripheral passages and in the passage hole. Therefore, even if the water freezes, there is substantially no chance that a force may be applied to the heat transfer plates in the stacking direction. Hence, the plate heat exchanger is hardly damaged because of disconnection between the heat transfer plates. However, for example, if the water freezes gradually from a central part of a passage and the freezing lastly reaches a region close to a refrigerant inlet or outlet, no spaces that allow the water to expand are provided. Therefore, the frozen water applies a force acting in the stacking direction to the heat transfer plates. Consequently, the heat transfer plates may be disconnected from each other, and the plate heat exchanger may be damaged.

SUMMARY

The present invention is to prevent a plate heat exchanger from being damaged by freezing of a fluid in the plate heat exchanger.

A plate heat exchanger according to the present invention is a plate heat exchanger including first plates that are rectangular in shape;

second plates that are rectangular in shape, the second plates being alternately stacked with the first plates, the first plates and the second plates being provided with passage holes at four corners of the first plates and the second plates, the passage holes serving as inlets and outlets for a first fluid and a second fluid;

first passages through which the first fluid flows; and second passages through which the second fluid flows, the first passages and the second passages being alternately formed between adjacent ones of the first plates and the second plates in a stacking direction, wherein each of the first passages allows the first fluid having flowed therein from a first inlet to flow out of a first outlet, the first inlet being one of the passage holes that is on one side in a long-side direction each of the first plates and each of the second plates, the first outlet being one of the passage holes that is on another side in the long-side direction, the first passage including a heat-exchanging passage that extends between the first inlet and the first outlet and allows the first fluid to exchange heat with the second fluid flowing in a corresponding one of the second passages adjacent to the first passage, wherein each of the first plates includes, in the heat-exchanging passage thereof, first waves formed in a corrugated portion, protruding in the stacking direction and including a plurality of top parts and a plurality of bottom parts alternately formed in a repeated manner from the first inlet toward the first outlet, and second waves formed in a corrugated portion, protruding in the stacking direction and connected to the first waves, the second waves being formed on a side of an upstream-side adjacent hole in the heat-exchanging passage, the upstream-side adjacent hole being another one of the passage holes that is on the one side in the long-side direction and is different from the inlet, and wherein the top parts of the first waves and top parts of the second waves have respective planar shapes, and the top parts of the first waves have a larger top width than the top parts of the second waves, the top width being a width in a direction perpendicular to ridges of each corrugated portion.

In the plate heat exchanger according to the present invention, the top parts of the first waves have a larger top width than the top parts of the second waves. Hence, a region including the second waves has a larger heat exchange area than a region including the first waves. Therefore, a larger amount of heat is exchanged in the region including the second waves than in the region including the first waves. Accordingly, if either of the fluids freezes in the plate heat exchanger, the fluid freezes earlier in the region including the second waves than in the region including the first waves, that is, there is no chance that the fluid may freeze lastly in the region including the second waves. Since the fluid does not freeze lastly in a closed region, the plate heat exchanger is prevented from being damaged.

DETAILED DESCRIPTION

There are a plate heat exchanger in which heat transfer plates of two different kinds are stacked alternately, and a plate heat exchanger in which heat transfer plates of one kind are stacked such that the orientations thereof alternate. In the case where heat transfer plates of two different kinds are stacked alternately, the shapes of the heat transfer plates of the two different kinds can be designed independently of each other, increasing the design flexibility. However, the necessity of manufacturing the heat transfer plates of two different kinds increases the manufacturing cost. On the other hand, in the case where heat transfer plates of one kind are stacked such that the orientations thereof alternate, the manufacturing cost is suppressed because the heat transfer plates of one kind only need to be manufactured. However, the design flexibility is low because the plate heat exchanger only includes one kind of heat transfer plates.

Embodiments 1 and 2 each concern the case where heat transfer plates of two different kinds are stacked alternately. Embodiment 3 concerns the case where heat transfer plates of one kind are stacked such that the orientations thereof alternate.

Embodiment 1

A basic configuration of a plate heat exchanger 30 according to Embodiment 1 will now be described.

Figure 1:
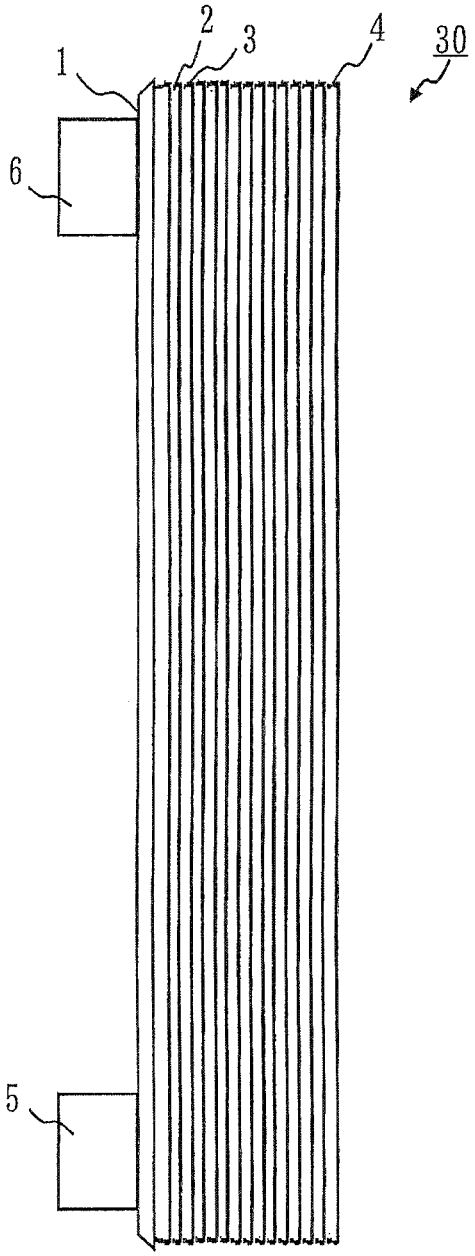
FIG. 1 is a side view of a plate heat exchanger 30.
Figure 2:
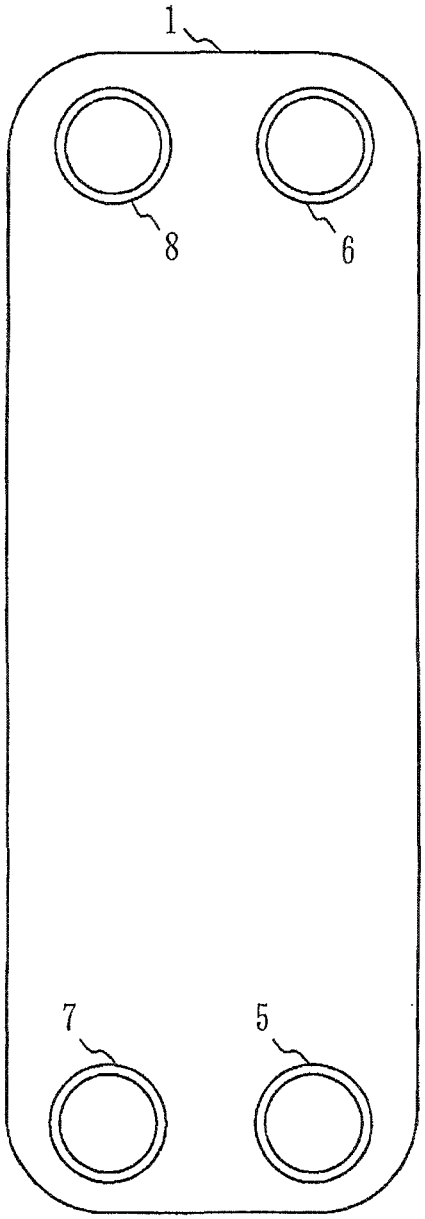
FIG. 2 is a front view of a reinforcing side plate 1.
Figure 3:
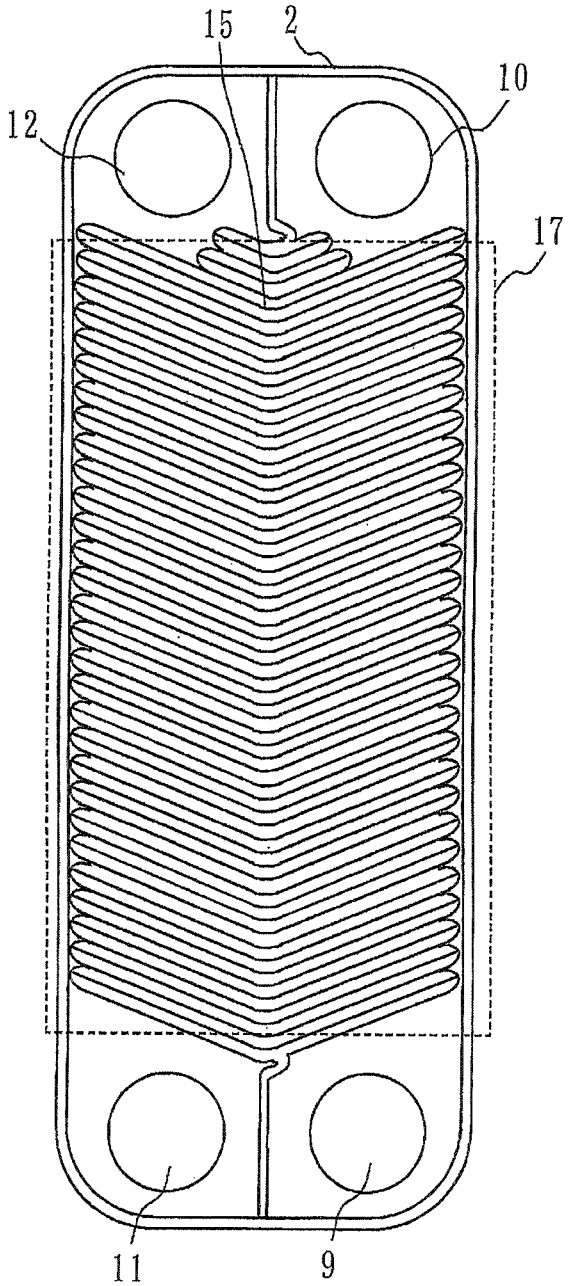
FIG. 3 is a front view of a heat transfer plate 2.
Figure 4:
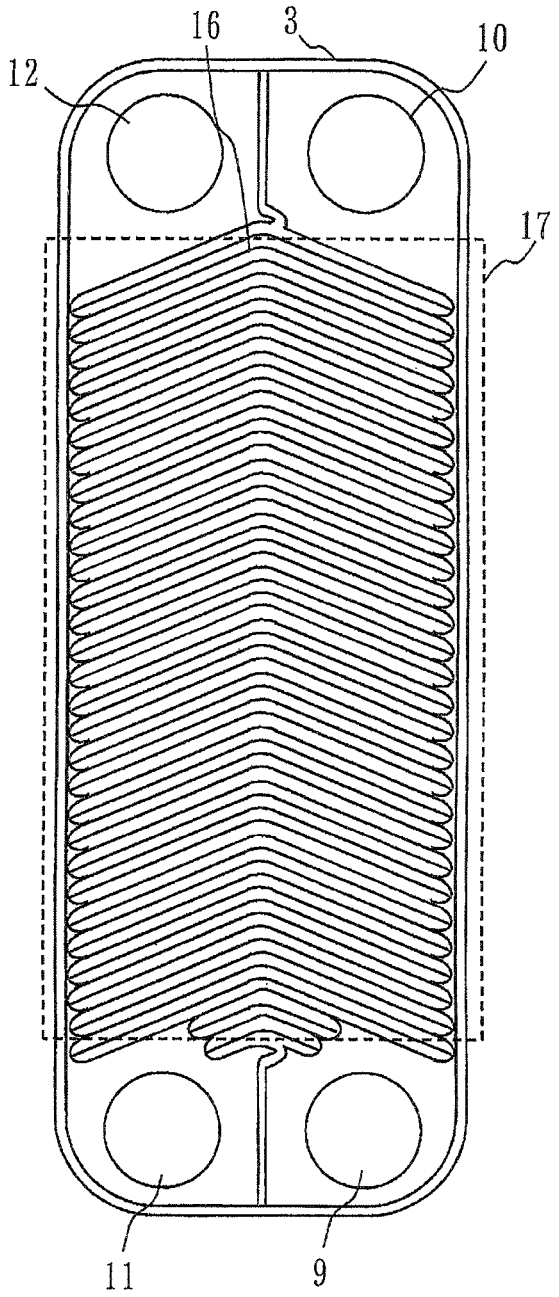
FIG. 4 is a front view of a heat transfer plate 3.
Figure 5:
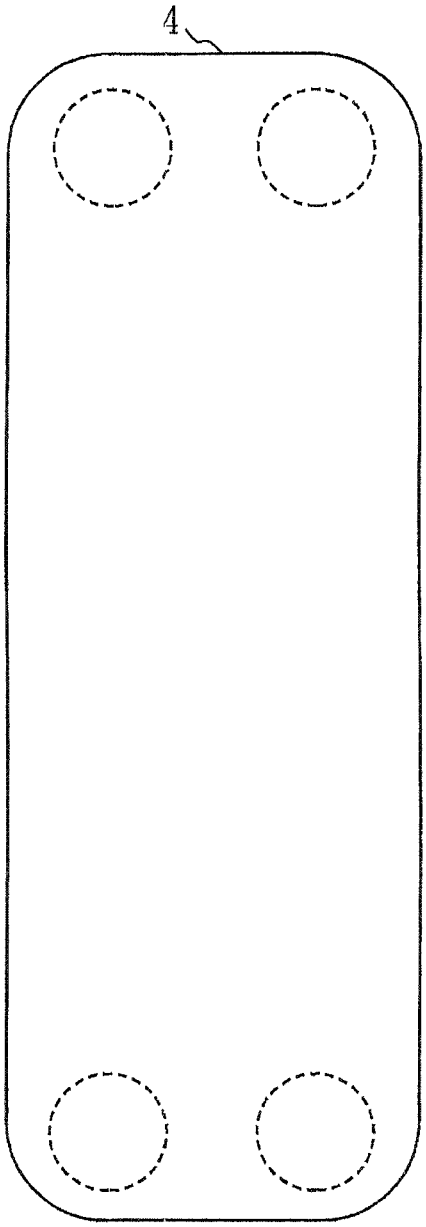
FIG. 5 is a front view of a reinforcing side plate 4.
Figure 6:
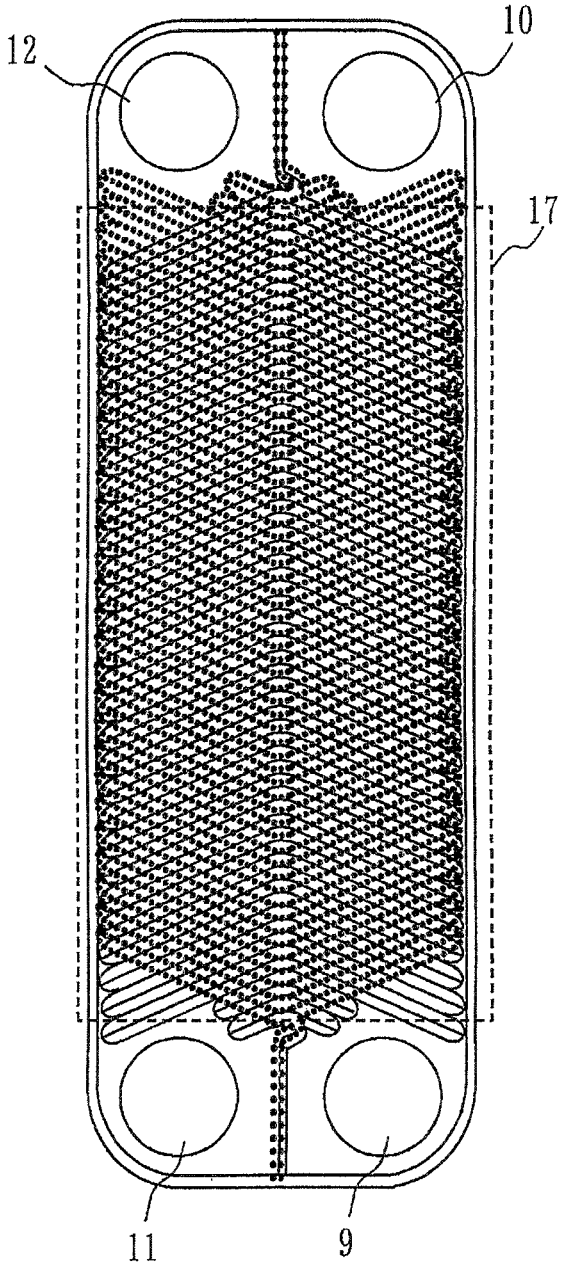
FIG. 6 is a diagram illustrating a state where the heat transfer plate 2 and the heat transfer plate 3 are stacked.
Figure 7:
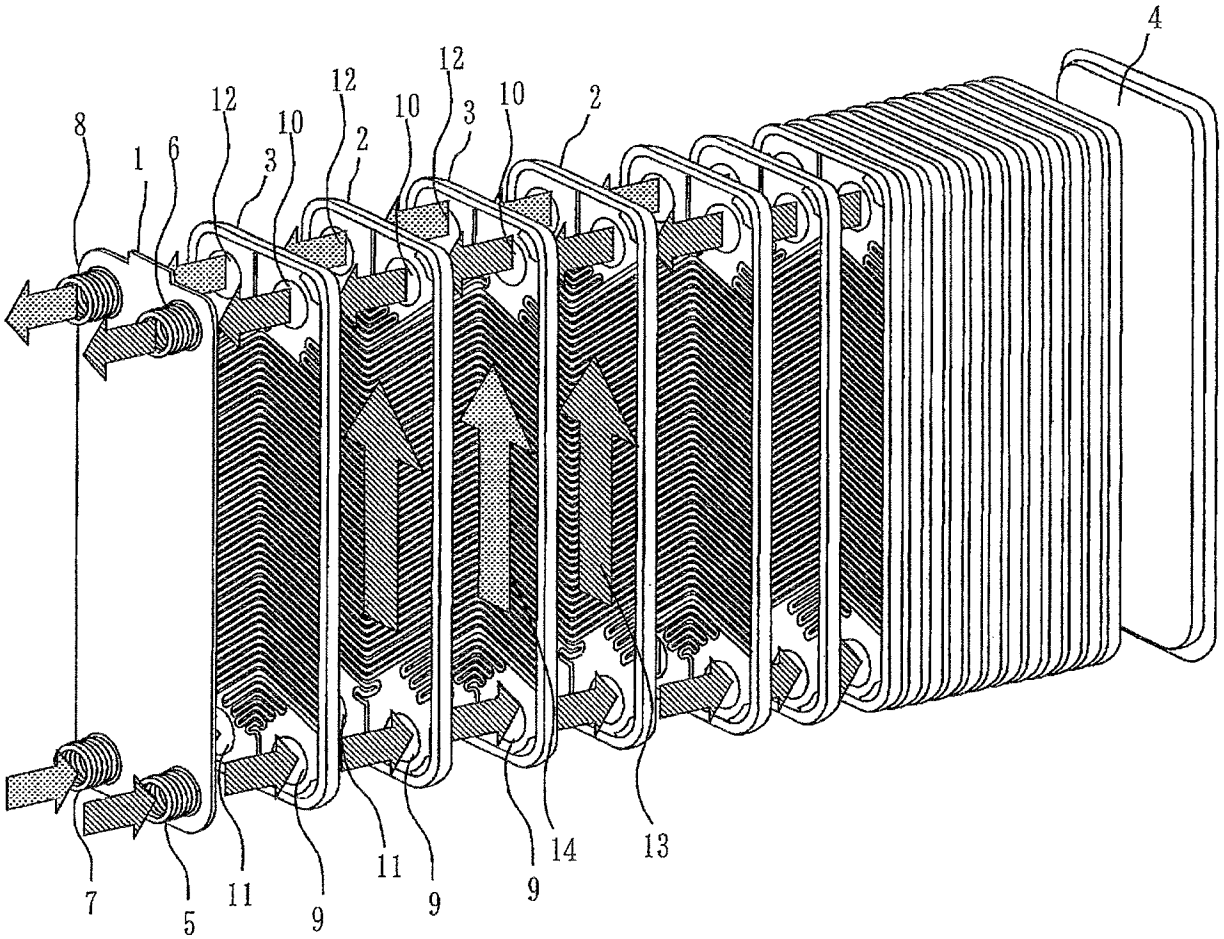
FIG. 7 is an exploded perspective view of the plate heat exchanger 30.

FIG. 1 is a side view of the plate heat exchanger 30. FIG. 2 is a front view of a reinforcing side plate 1 (seen in a stacking direction). FIG. 3 is a front view of a heat transfer plate 2 (a first plate). FIG. 4 is a front view of a heat transfer plate 3 (a second plate). FIG. 5 is a front view of a reinforcing side plate 4. FIG. 6 is a diagram illustrating a state where the heat transfer plate 2 and the heat transfer plate 3 are stacked. FIG. 7 is an exploded perspective view of the plate heat exchanger 30.

In Embodiment 1, the heat transfer plates 2 and 3 are different heat transfer plates that are manufactured with, for example, respectively different molds.

As illustrated in FIG. 1, the plate heat exchanger 30 includes heat transfer plates 2 and heat transfer plates 3 that are stacked alternately. The plate heat exchanger 30 further includes the reinforcing side plate 1 provided on the frontmost side thereof and the reinforcing side plate 4 provided on the rearmost side thereof.

As illustrated in FIG. 2, the reinforcing side plate 1 has a substantially rectangular plate shape. The reinforcing side plate 1 is provided with a first inflow pipe 5, a first outflow pipe 6, a second inflow pipe 7, and a second outflow pipe 8 at the four respective corners of the substantially rectangular shape thereof.

As illustrated in FIGS. 3 and 4, each of the heat transfer plates 2 and 3 has a substantially rectangular plate shape, as with the reinforcing side plate 1, and has a first inlet 9, a first outlet 10, a second inlet 11 (an upstream-side adjacent hole), and a second outlet 12 (a downstream-side adjacent hole) at the four respective corners thereof. Furthermore, the heat transfer plates 2 and 3 have respective corrugated portions 15 and 16 (first waves) protruding in the plate stacking direction. The corrugated portions 15 and 16 each have a substantially V shape when seen in the stacking direction, with a plurality of top parts and a plurality of bottom parts provided alternately in a direction from the first inlet 9 and the second inlet 11 toward the first outlet 10 and the second outlet 12. Note that the substantially V shape of the corrugated portion 15 formed in the heat transfer plate 2 and the substantially V shape of the corrugated portion 16 formed in the heat transfer plate 3 are inverse to each other.

As illustrated in FIG. 5, the reinforcing side plate 4 has a substantially rectangular plate shape, as with the reinforcing side plate 1 and other plates. The reinforcing side plate 4 is provided with none of the first inflow pipe 5, the first outflow pipe 6, the second inflow pipe 7, and the second outflow pipe 8. In FIG. 5, positions of the reinforcing side plate 4 that correspond to the first inflow pipe 5, the first outflow pipe 6, the second inflow pipe 7, and the second outflow pipe 8 are represented by broken lines. This does not mean that the reinforcing side plate 4 is provided with them.

As illustrated in FIG. 6, when the heat transfer plate 2 and the heat transfer plate 3 are stacked, the corrugated portions 15 and 16 having the respective substantially V shapes that are inverse to each other face each other, whereby a passage that produces a complex flow is formed between the heat transfer plate 2 and the heat transfer plate 3.

As illustrated in FIG. 7, the heat transfer plates 2 and 3 are stacked such that the respective first inlets 9 face one another, the respective first outlets 10 face one another, the respective second inlets 11 face one another, and the respective second outlets 12 face one another. The reinforcing side plate 1 and one of the heat transfer plates 2 are stacked such that the first inflow pipe 5 and the first inlet 9 face each other, the first outflow pipe 6 and the first outlet 10 face each other, the second inflow pipe 7 and the second inlet 11 face each other, and the second outflow pipe 8 and the second outlet 12 face each other. The heat transfer plates 2 and 3 and the reinforcing side plates 1 and 4 are stacked such that the outer circumferential edges thereof face one another and are bonded to one another by brazing or the like. The heat transfer plates 2 and 3 are bonded not only at the outer circumferential edges thereof but also at positions where, when seen in the stacking direction, the bottom parts of the corrugated portion of one of each pair of heat transfer plates that is on the upper side (front side) and the top parts of the corrugated portion of the other heat transfer plate that is on the lower side (rear side) face each other.

In this manner, a first passage 13 through which water (an exemplary first fluid) having flowed from the first inflow pipe 5 flows out of the first outflow pipe 6 is formed between the back side of each heat transfer plate 3 and the front side of a corresponding one of the heat transfer plates 2. Likewise, a second passage 14 through which a refrigerant (an exemplary second fluid) having flowed from the second inflow pipe 7 flows out of the second outflow pipe 8 is formed between the back side of each heat transfer plate 2 and the front side of a corresponding one of the heat transfer plates 3.

The water having flowed from the outside into the first inflow pipe 5 flows through a passage hole formed by the first inlets 9 of the respective heat transfer plates 2 and 3 that face one another, and flows into each of the first passages 13. The water having flowed into the first passage 13 flows in a long-side direction while gradually spreading in a short-side direction and flows out of the first outlet 10. The water having flowed into the first outlet 10 flows through a passage hole formed by facing the first outlets 10 one another, and is discharged from the first outflow pipe 6 to the outside.

Likewise, the refrigerant having flowed from the outside into the second inflow pipe 7 flows through a passage hole formed by facing the second inlets 11 of the respective heat transfer plates 2 and 3 one another, and flows into each of the second passages 14. The refrigerant having flowed into the second passage 14 flows in the long-side direction while gradually spreading in the short-side direction and flows out of the second outlet 12. The refrigerant having flowed out of the second outlet 12 flows through a passage hole formed by facing the second outlets 12 one another, and is discharged from the second outflow pipe 8 to the outside.

The water that flows through the first passage 13 and the refrigerant that flows through the second passage 14 exchange heat therebetween via the heat transfer plates 2 and 3 when flowing through regions where the corrugated portions 15 and 16 are formed. The regions of the first passage 13 and the second passage 14 where the respective corrugated portions 15 and 16 are formed are referred to as heat-exchanging passages 17 (see FIGS. 3, 4, and 6).

Features of the plate heat exchanger 30 according to Embodiment 1 will now be described.

Figure 8:
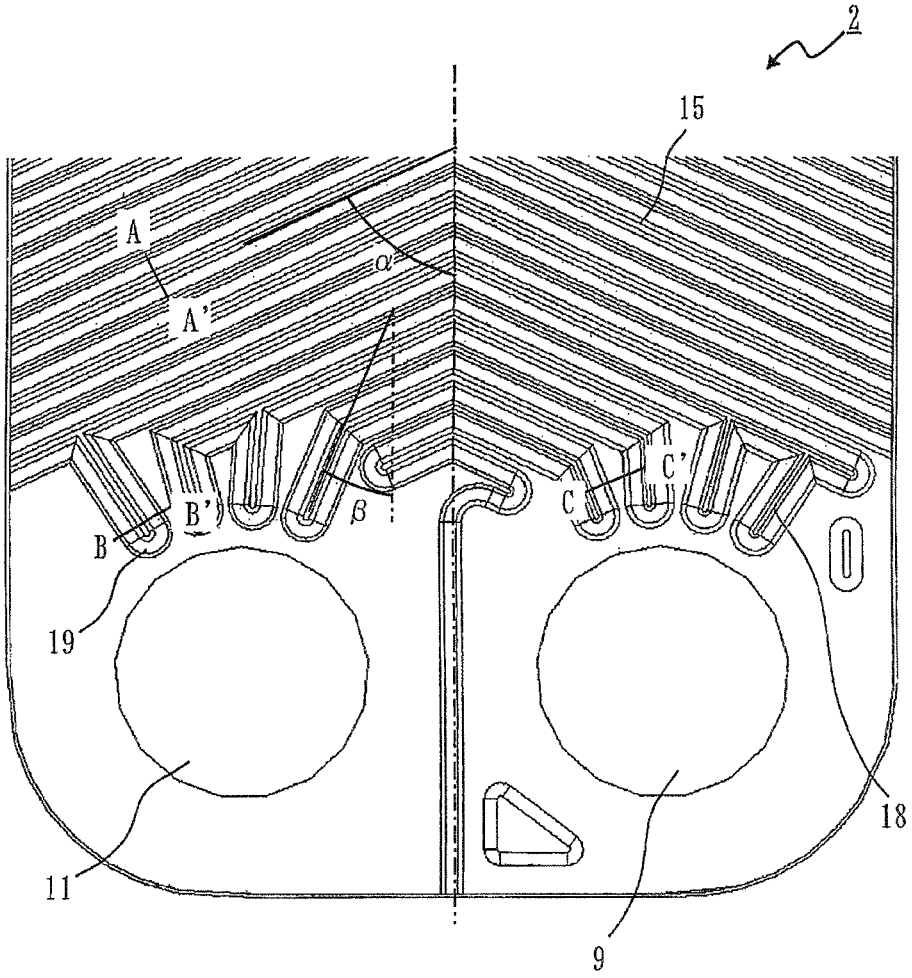
FIG. 8 is a front view illustrating a part of the heat transfer plate 2 according to Embodiment 1.
Figure 9:
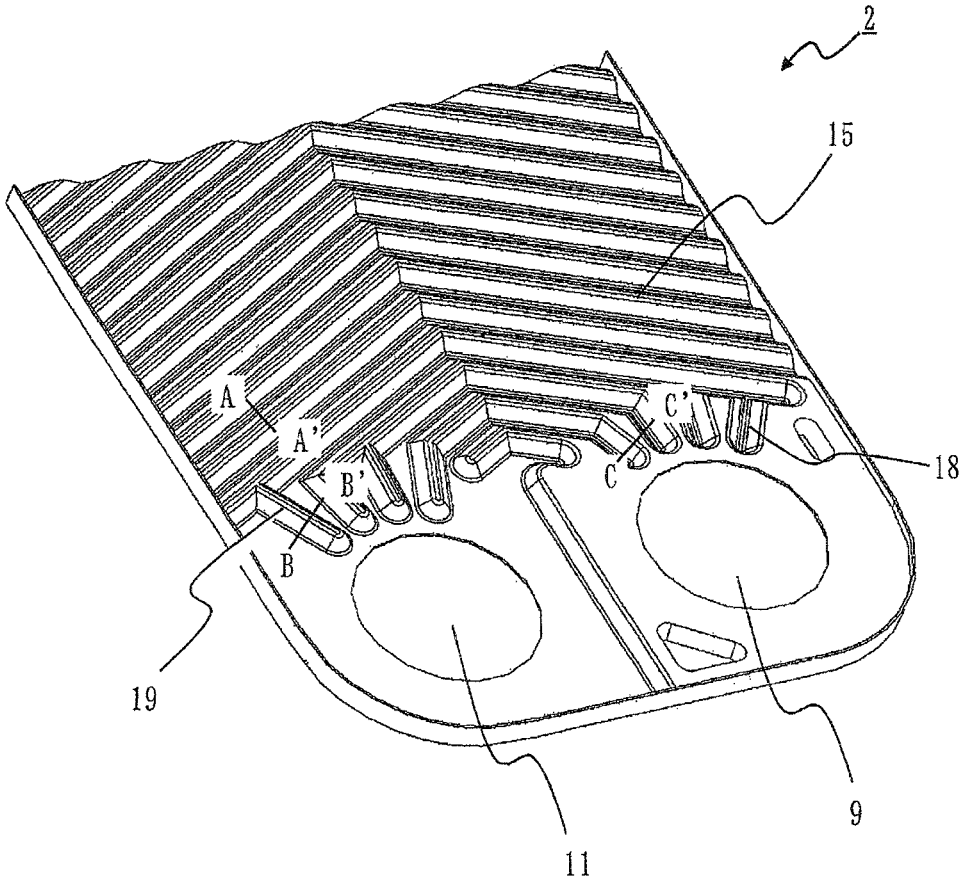
FIG. 9 is a perspective view illustrating a part of the heat transfer plate 2 according to Embodiment 1.
Figure 10:
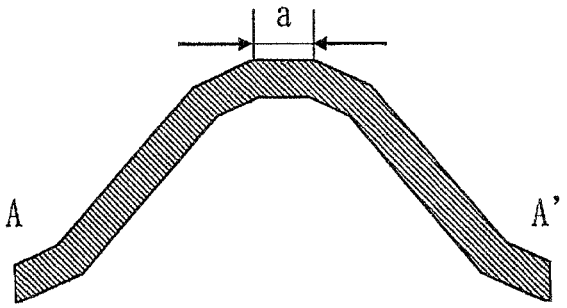
FIG. 10 is a sectional view taken along line A-A' illustrated in FIGS. 8 and 9.
Figure 11:
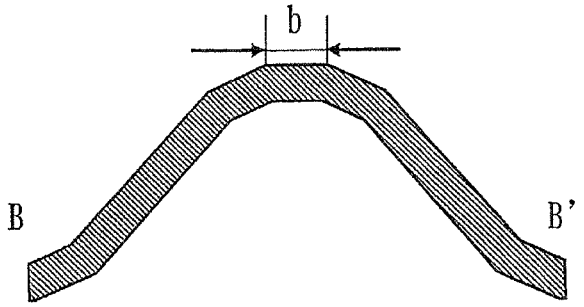
FIG. 11 is a sectional view taken along line B-B' illustrated in FIGS. 8 and 9.
Figure 12:
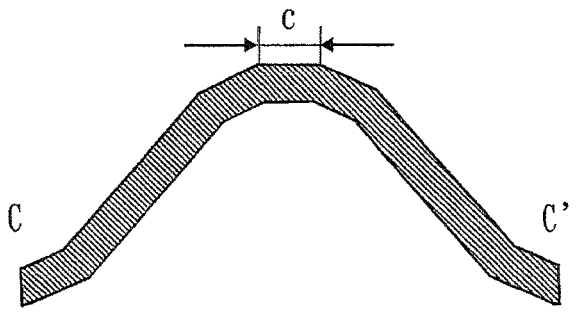
FIG. 12 is a sectional view taken along line C-C' illustrated in FIGS. 8 and 9.

FIGS. 8 to 12 are diagrams of the heat transfer plate 2 according to Embodiment 1. FIG. 8 is a front view illustrating a part of the heat transfer plate 2 according to Embodiment 1. FIG. 9 is a perspective view illustrating a part of the heat transfer plate 2 according to Embodiment 1. FIG. 10 is a sectional view taken along line A-A' illustrated in FIGS. 8 and 9. FIG. 11 is a sectional view taken along line B-B' illustrated in FIGS. 8 and 9. FIG. 12 is a sectional view taken along line C-C' illustrated in FIGS. 8 and 9.

Figure 13:
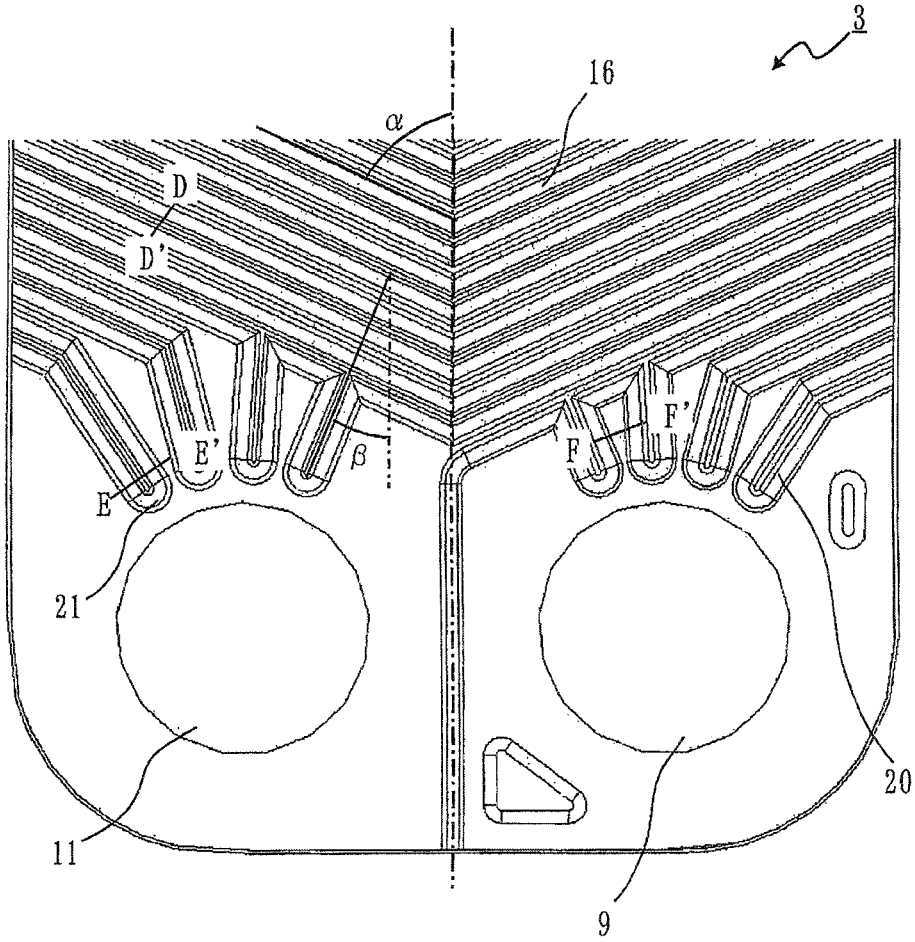
FIG. 13 is a front view illustrating a part of the heat transfer plate 3 according to Embodiment 1.
Figure 14:
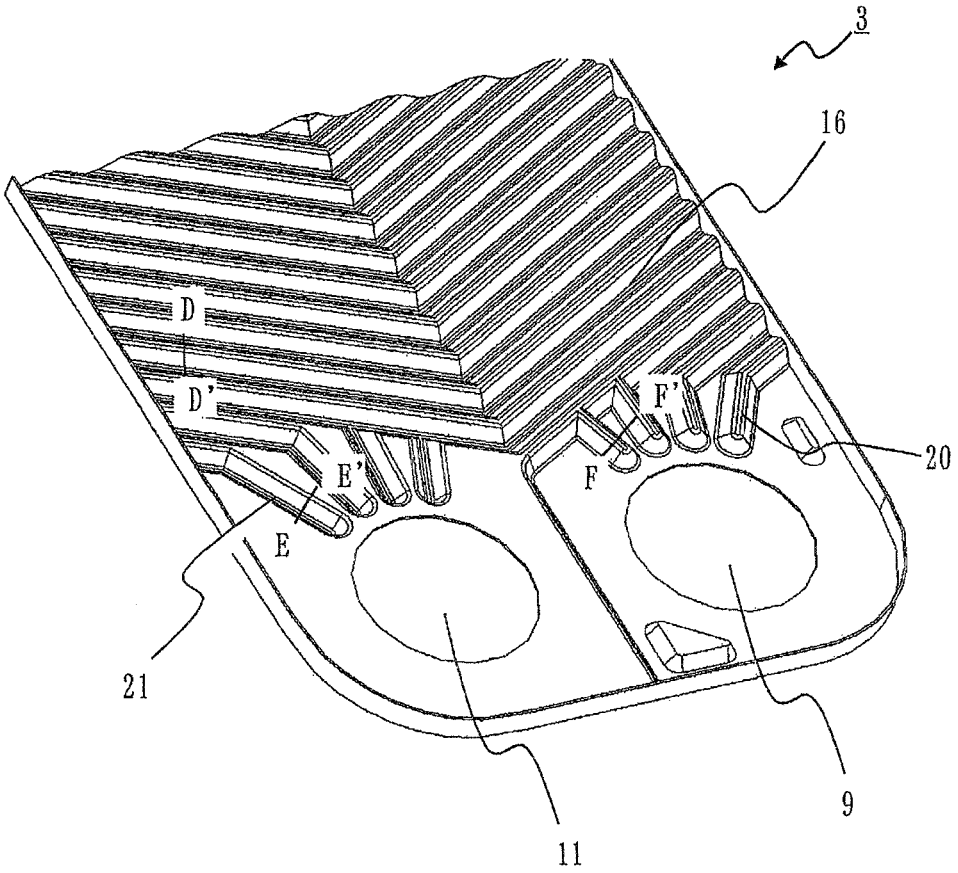
FIG. 14 is a perspective view illustrating a part of the heat transfer plate 3 according to Embodiment 1.
Figure 15:
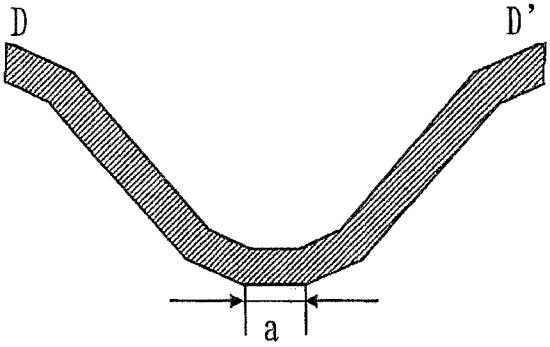
FIG. 15 is a sectional view taken along line D-D' illustrated in FIGS. 13 and 14.
Figure 16:
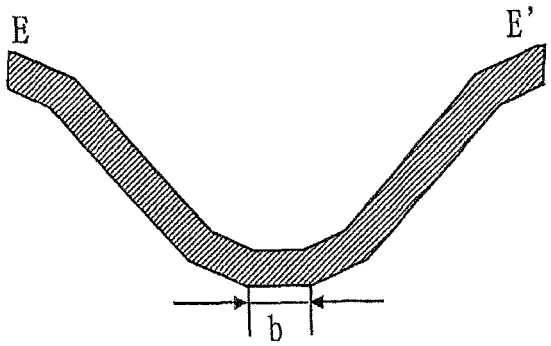
FIG. 16 is a sectional view taken along line E-E' illustrated in FIGS. 13 and 14.
Figure 17:
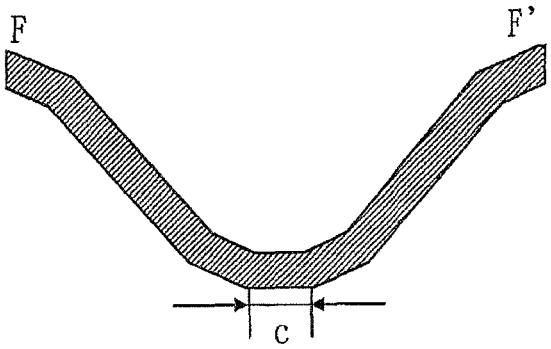
FIG. 17 is a sectional view taken along line F-F' illustrated in FIGS. 13 and 14.

FIGS. 13 to 17 are diagrams of the heat transfer plate 3 according to Embodiment 1. FIG. 13 is a front view illustrating a part of the heat transfer plate 3 according to Embodiment 1. FIG. 14 is a perspective view illustrating a part of the heat transfer plate 3 according to Embodiment 1. FIG. 15 is a sectional view taken along line D-D' illustrated in FIGS. 13 and 14. FIG. 16 is a sectional view taken along line E-E' illustrated in FIGS. 13 and 14. FIG. 17 is a sectional view taken along line F-F' illustrated in FIGS. 13 and 14.

Figure 18:
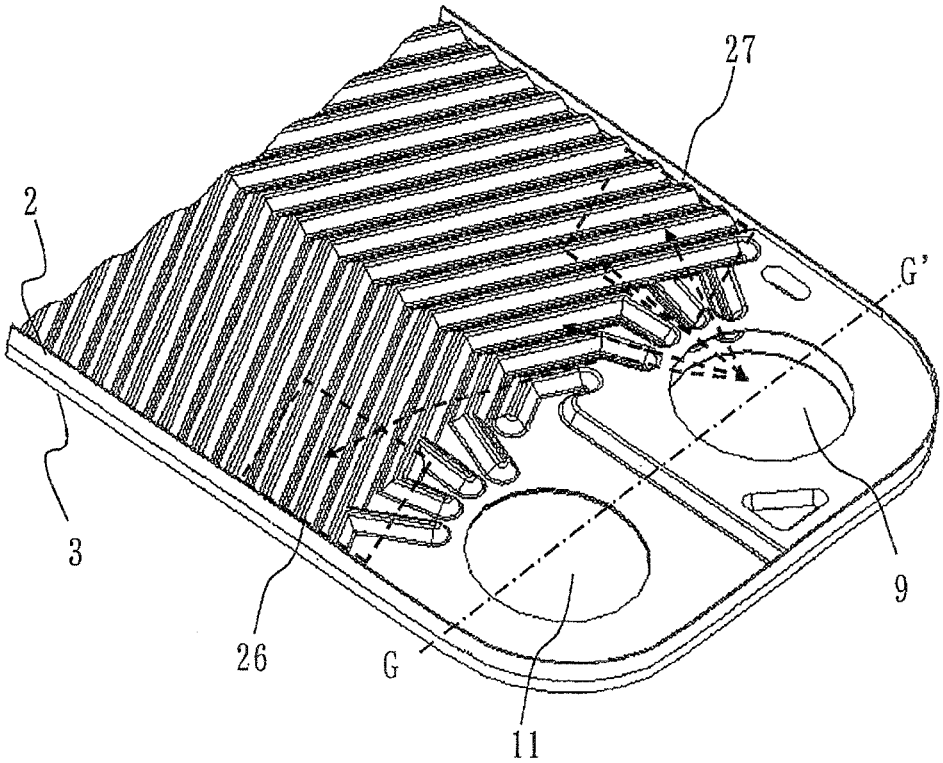
FIG. 18 is a perspective view illustrating a state where the heat transfer plates 2 and 3 according to Embodiment 1 are stacked.
Figure 19:
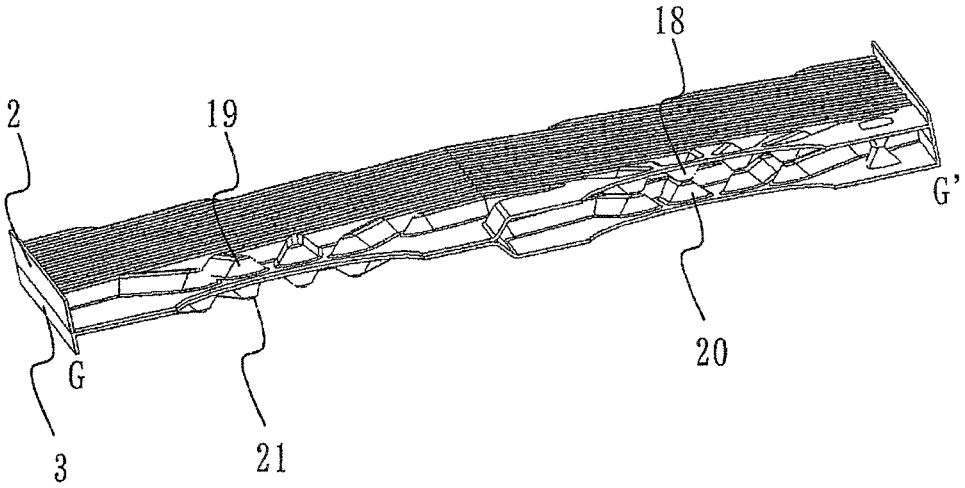
FIG. 19 is a perspective view illustrating a section taken along line G-G' illustrated in FIG. 18.

FIG. 18 is a perspective view illustrating a state where the heat transfer plates 2 and 3 according to Embodiment 1 are stacked. FIG. 19 is a perspective view illustrating a section taken along line G-G' illustrated in FIG. 18.

As illustrated in FIGS. 8 and 9, the heat transfer plate 2 includes a corrugated portion 18 (third waves) and a corrugated portion 19 (second waves) formed on a side of the first inlet 9 and the second inlet 11. The ridges of the corrugated portion 18 and the corrugated portion 19 radially extend toward the corrugated portion 15 with respect to the first inlet 9 and the second inlet 11, respectively. One end of each of the corrugated portions 18 and 19 is connected to the corrugated portion 15.

As illustrated in FIGS. 13 and 14, the heat transfer plate 3 includes a corrugated portion 20 (second waves) and a corrugated portion 21 (third waves) formed on a side of the first inlet 9 and the second inlet 11. The ridges of the corrugated portion 20 and the corrugated portion 21 radially extend toward the corrugated portion 16 with respect to the first inlet 9 and the second inlet 11, respectively. One end of each of the corrugated portions 20 and 21 is connected to the corrugated portion 16.

As illustrated in FIGS. 18 and 19, in the corrugated portions 18 and 19 of the heat transfer plate 2 and the corrugated portions 20 and 21 of the heat transfer plate 3, the top parts of the corrugated portions 18 and 19 and the bottom parts of the corrugated portions 20 and 21 face each other, and the bottom parts of the corrugated portions 18 and 19 and the top parts of the corrugated portions 20 and 21 face each other.

The top parts and the bottom parts of the corrugated portions 15, 16, 18, 19, 20, and 21 each have a planar shape. The widths of the top part and the bottom part of each corrugated portion in a direction perpendicular to the ridge of the corrugated portion are referred to as top width and bottom width, respectively. The top width and the bottom width (width a) of the corrugated portions 15 and 16 illustrated in FIGS. 10 and 15 are larger than the top width and the bottom width (width b) of the corrugated portions 19 and 21 illustrated in FIGS. 11 and 16 (a>b). The top width and the bottom width (width c) of the corrugated portions 18 and 20 illustrated in FIGS. 12 and 17 are larger than the top width and the bottom width (width a) of the corrugated portions 15 and 16 illustrated in FIGS. 10 and 15 (c>a). That is, the relationship among the widths a, b, and c is expressed as c>a>b.

Figure 20:
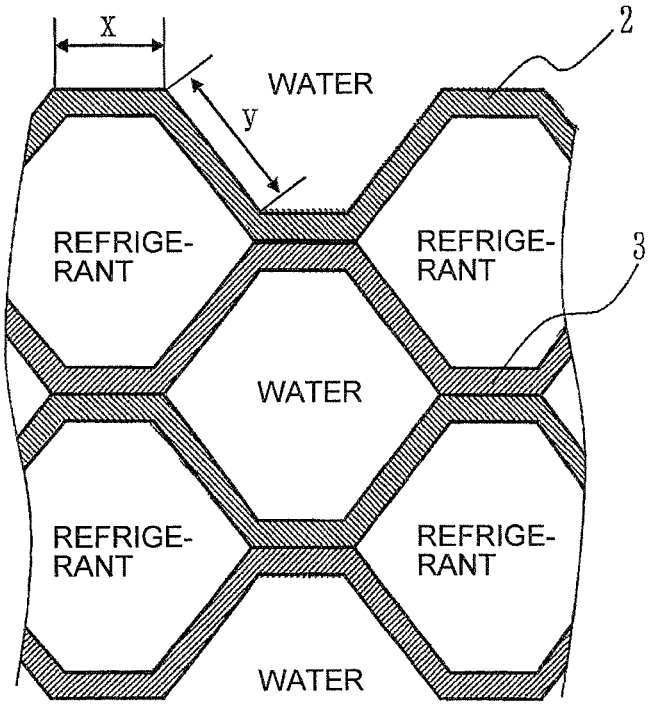
FIG. 20 is a diagram illustrating first passages 13 and second passages 14 formed between adjacent ones of the heat transfer plates 2 and 3.

FIG. 20 is a diagram illustrating the first passages 13 and the second passages 14 formed between adjacent ones of the heat transfer plates 2 and 3. Passages in which the water flows correspond to the first passages. Passages in which the refrigerant flows correspond to the second passages.

A portion of the water and another portion of the water or a portion of the refrigerant and another portion of the refrigerant are in contact with each other via the heat transfer plates 2 and 3 at each of the top parts and the bottom parts (the parts each having a width x in FIG. 20) of the corrugated portions of the heat transfer plates 2 and 3. Hence, the water and the refrigerant do not exchange heat therebetween at the top parts and the bottom parts. In contrast, a portion of the water and a portion of the refrigerant are in contact with each other via the heat transfer plate 2 or 3 at each of sloping parts (the parts each having a width y in FIG. 20) of the corrugated portion of the heat transfer plate 2. Hence, the water and the refrigerant exchange heat therebetween at the sloping parts.

The smaller the width x of the top parts and the bottom parts, the larger the width y of the sloping parts. That is, the smaller the width x of the top parts and the bottom parts, the larger the heat exchange area where the water and the refrigerant exchange heat therebetween. As described above, the relationship among the widths x (widths a, b, and c) of the top parts and the bottom parts of the corrugated portions 15, 16, 18, 19, 20, and 21 is expressed as c>a>b. That is, a region including the corrugated portions 19 and 21 whose top width and bottom width each correspond to the width b has the largest heat exchange area. The heat exchange area becomes smaller in the following order: a region including the corrugated portions 15 and 16 whose top width and bottom width each correspond to the width a, and a region including the corrugated portions 18 and 20 whose top width and bottom width each correspond to the width c.

The water having flowed from the first inlet 9 is gradually cooled while flowing through the first passage 13, and is cooled to the lowest temperature near the first outlet 10. Hence, if the water freezes in the plate heat exchanger 30, the water normally starts to freeze near the first outlet 10 and the second outlet 12 that are on the downstream side. The freezing gradually proceeds from that region toward the first inlet 9 and the second inlet 11 that are on the upstream side, and lastly reaches a region near the first inlet 9 and the second inlet 11.

If the water starts to freeze near the first outlet 10, spaces that allow the water to expand are provided in the first outlet 10, on the side toward the first inlet 9, and in some other regions. Hence, no force attributed to the expansion of the frozen water is applied in the stacking direction. Accordingly, there is less chance that the heat transfer plates 2 and 3 may be disconnected from each other and the plate heat exchanger 30 may be damaged. Likewise, if the water freezes near the first inlet 9, a space that allows the water to expand is provided in the first inlet 9. Accordingly, there is less chance that the plate heat exchanger 30 may be damaged. However, if the water lastly freezes at the second inlet 11, no space that allows the water to expand is provided because the first passage 13 is closed near the second inlet 11. Therefore, a force attributed to the expansion of the frozen water is applied in the stacking direction. Consequently, the heat transfer plates 2 and 3 may be disconnected from each other, and the plate heat exchanger 30 may be damaged.

As described above, the region including the corrugated portions 19 and 21 has a larger heat exchange area than the region including the corrugated portions 15 and 16. Therefore, the water freezes earlier in the region including the corrugated portions 19 and 21 than in the region including the corrugated portions 15 and 16. Furthermore, the region including the corrugated portions 15 and 16 has a larger heat exchange area than the region including the corrugated portions 18 and 20. Therefore, the water freezes earlier in the region including the corrugated portions 15 and 16 than in the region including the corrugated portions 18 and 20.

Hence, unlike the normal case described above, if the water freezes in the plate heat exchanger 30, the water starts to freeze near the first outlet 10 and in the region including the corrugated portions 19 and 21. Then, the freezing in such regions gradually proceeds toward the first inlet 9, and lastly reaches the region including the corrugated portions 18 and 20.

If the water starts to freeze near the first outlet 10, spaces that allow the water to expand are provided in the first outlet 10, on the side toward the first inlet 9, and in some other regions. If the water freezes in the region including the corrugated portions 19 and 21, a space that allows the water to expand is provided on the side toward the region including the corrugated portions 15 and 16. Then, if the water freezes in the region including the corrugated portions 15 and 16, a space that allows the water to expand is provided on the side toward the region including the corrugated portions 18 and 20. Lastly, if the water freezes in the region including the corrugated portions 18 and 20, a space that allows the water to expand is provided in the first inlet 9. Hence, if the water freezes in the above order, any spaces that allow the water to expand are always provided. Therefore, no force attributed to the expansion of the frozen water is applied in the stacking direction, and there is less chance that the heat transfer plates 2 and 3 may be disconnected from each other and the plate heat exchanger 30 may be damaged.

As described above, the plate heat exchanger 30 according to Embodiment 1 is prevented from being damaged even if the fluid freezes in the plate heat exchanger 30.

If none of the corrugated portions 18, 19, 20, and 21 are formed, the water having flowed from the first inlet 9 into the first passage 13 directly collides with the corrugated portions 15 and 16 having the respective V shapes. In such a case, a pressure loss occurs, and the speed distribution in the short-side direction of the heat transfer plates 2 and 3 becomes nonuniform. Furthermore, the water is disrupted to flow into a stagnation region 26 illustrated in FIG. 18 and tends to stagnate in the stagnation region 26.

Likewise, the refrigerant having flowed from the second inlet 11 into the second passage 14 directly collides with the corrugated portions 15 and 16 having the respective V shapes. In such a case, a pressure loss occurs, and the speed distribution in the short-side direction of the heat transfer plates 2 and 3 becomes nonuniform. Furthermore, the refrigerant is disrupted to flow into a stagnation region 27 illustrated in FIG. 18 and tends to stagnate in the stagnation region 27.

In the regions where the water and the refrigerant are stagnated, heat is not efficiently exchanged. Hence, the heat exchange area is reduced by an amount corresponding to the stagnation regions 26 and 27.

In contrast, if the corrugated portions 18, 19, 20, and 21 are formed, the water having flowed from the first inlet 9 into the first passage 13 collides with the corrugated portions 18 and 20 whose ridges radially extend with respect to the first inlet 9 before colliding with the corrugated portions 15 and 16 extending in the V shapes. The angle (denoted by $\beta$ in FIGS. 8 and 13) formed between each of the ridges of the corrugated portions 18 and 20 and a line parallel to the long sides of the heat transfer plates 2 and 3 is smaller than the angle (denoted by $\alpha$ in FIGS. 8 and 13) formed between each of the corrugated portions 15 and 16 and the line parallel to the long sides of the heat transfer plates 2 and 3. Hence, the pressure loss is smaller and the speed distribution in the short-side direction is more uniform than in the case where the water directly collides with the corrugated portions 15 and 16. The same applies to the refrigerant that flows through the second passage 14. That is, the pressure loss is smaller and the speed distribution in the short-side direction is more uniform.

Furthermore, in the case where the corrugated portions 18, 19, 20, and 21 are formed, as illustrated by the broken-line arrows in FIG. 18, the water having flowed from the first inlet 9 into the first passage 13 is guided toward the stagnation region 26 by the corrugated portions 18 and 20 whose ridges radially extend. Hence, the water does not stagnate in the stagnation region 26. The same applies to the refrigerant that flows through the second passage 14. That is, the refrigerant does not stagnate in the stagnation region 27. Accordingly, heat is also exchanged in the stagnation regions 26 and 27.

In the case where the corrugated portions 18, 19, 20, and 21 are formed, the heat transfer plates 2 and 3 are also bonded to each other at the corrugated portions 18, 19, 20, and 21, increasing the strength of bonding between the heat transfer plates 2 and 3. Since the strength of bonding between the heat transfer plates 2 and 3 is increased, the reinforcing side plates 1 and 4 can each have a reduced thickness, suppressing the material cost.

As described above, the plate heat exchanger 30 according to Embodiment 1 has high heat-exchanging efficiency, small pressure loss, and high strength. Hence, a low-density, flammable refrigerant that functions at high pressure, such as CO2, hydrocarbon, or a low-GWP refrigerant, is employable.

Furthermore, the angle (denoted by β in FIGS. 8 and 13) formed between each of the ridges of the corrugated portions 18 and 20 and the line parallel to the long sides of the heat transfer plates 2 and 3 may be changed in accordance with the viscosity or other properties of the first fluid and the second fluid to be used. The same applies to the corrugated portions 19 and 21.

In the above description, the top parts and the bottom parts of the corrugated portions 15, 16, 18, 19, 20, and 21 each have a planar shape. Herein, the planar shape includes not only a completely flat shape but also a gently curved shape. If the top parts and the bottom parts each have a gently curved shape, the relationship among the widths a, b, and c may be adjusted in accordance with the curvatures thereof. That is, the relationship among a curvature θa of the top parts and the bottom parts of the corrugated portions 15 and 16, a curvature θb of the top parts and the bottom parts of the corrugated portions 19 and 21, and a curvature θc of the top parts and the bottom parts of the corrugated portions 18 and 20 may be expressed as $\theta c>\theta a>\theta b$.

Embodiment 2

In Embodiment 1, no particular description has been given with regard to a side of each of the heat transfer plates 2 and 3 having the first outlet 10 and the second outlet 12. In Embodiment 2, the side of each of the heat transfer plates 2 and 3 having the first outlet 10 and the second outlet 12 will be described.

Figure 21:
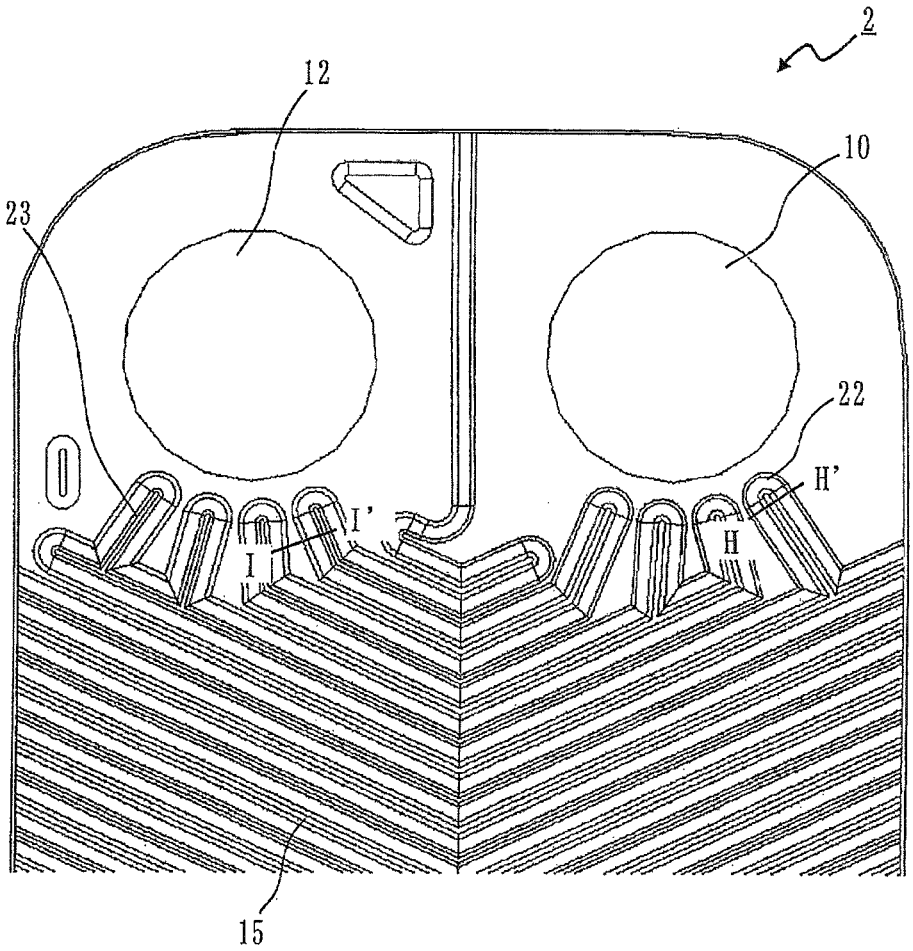
FIG. 21 is a front view illustrating a part of the heat transfer plate 2 according to Embodiment 2.
Figure 22:
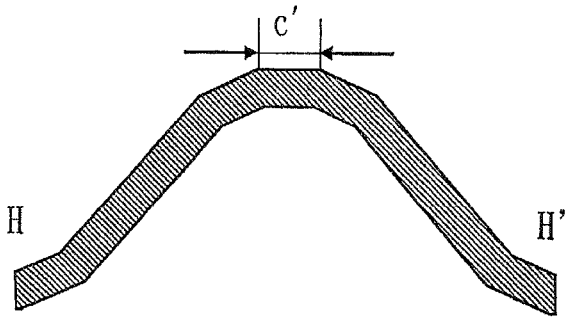
FIG. 22 is a sectional view taken along line H-H' illustrated in FIG. 21.
Figure 23:
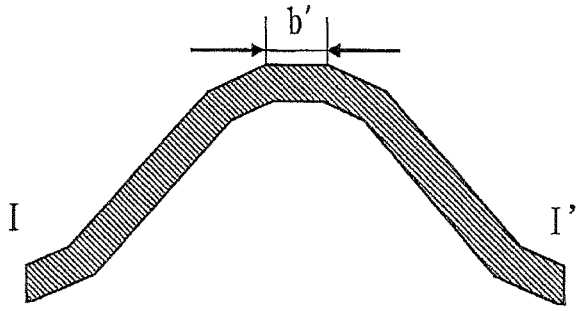
FIG. 23 is a sectional view taken along line I-I' illustrated in FIG. 21.

FIGS. 21 to 23 are diagrams illustrating the heat transfer plate 2 according to Embodiment 2. FIG. 21 is a front view illustrating a part of the heat transfer plate 2 according to Embodiment 2. While FIG. 8 illustrates the side of the heat transfer plate 2 having the first inlet 9 and the second inlet 11, FIG. 21 illustrates the side of the heat transfer plate 2 having the first outlet 10 and the second outlet 12. FIG. 22 is a sectional view taken along line H-H' illustrated in FIG. 21. FIG. 23 is a sectional view taken along line I-I' illustrated in FIG. 21.

Figure 24:
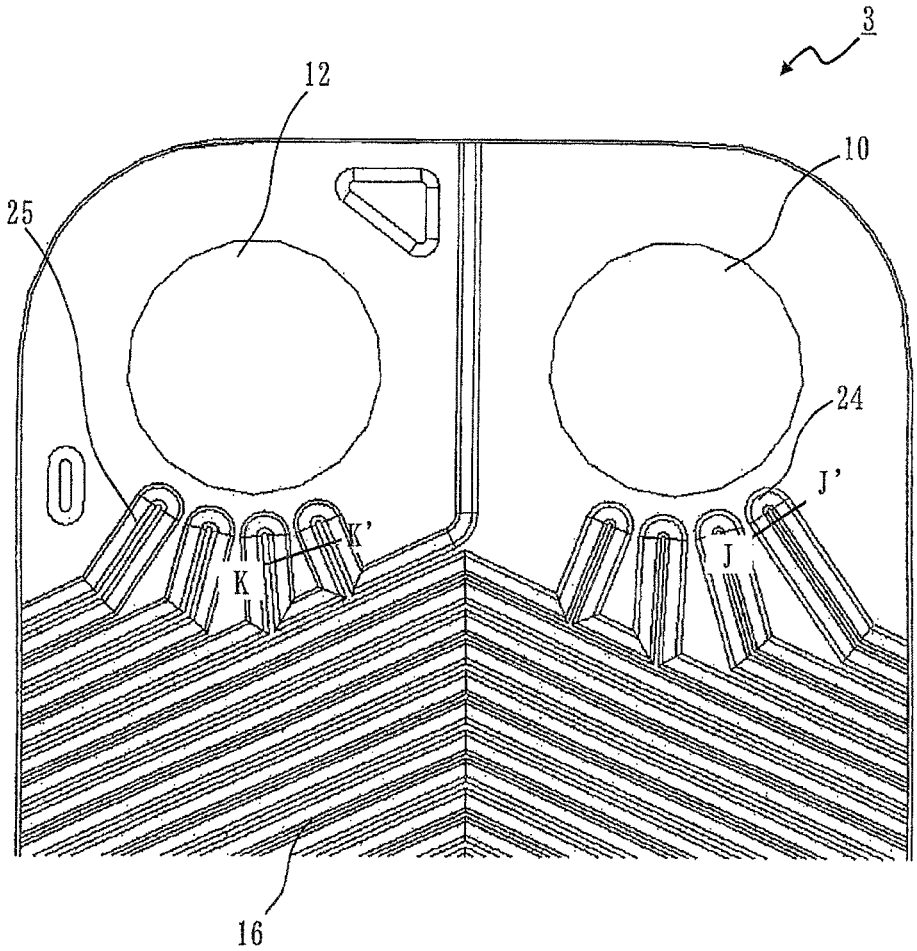
FIG. 24 is a front view illustrating a part of the heat transfer plate 3 according to Embodiment 2.
Figure 25:
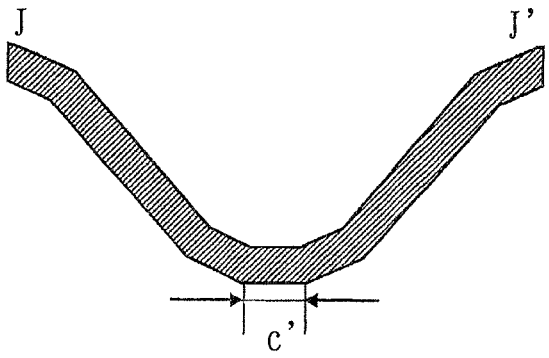
FIG. 25 is a sectional view taken along line J-J' illustrated in FIG. 24.
Figure 26:
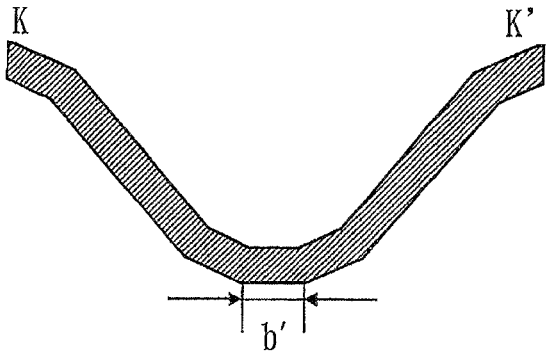
FIG. 26 is a sectional view taken along line K-K' illustrated in FIG. 24.

FIGS. 24 to 26 are diagrams illustrating the heat transfer plate 3 according to Embodiment 2. FIG. 24 is a front view illustrating a part of the heat transfer plate 3 according to Embodiment 2. While FIG. 13 illustrates the side of the heat transfer plate 3 having the first inlet 9 and the second inlet 11, FIG. 24 illustrates the side of the heat transfer plate 3 having the first outlet 10 and the second outlet 12. FIG. 25 is a sectional view taken along line J-J' illustrated in FIG. 24. FIG. 26 is a sectional view taken along line K-K' illustrated in FIG. 24.

As illustrated in FIG. 21, the heat transfer plate 2 includes a corrugated portion 22 and a corrugated portion 23 (fourth waves) formed on a side of the first outlet 10 and the second outlet 12, respectively. The ridges of the corrugated portion 22 and the corrugated portion 23 radially extend toward the corrugated portion 15 with respect to the first outlet 10 and the second outlet 12, respectively. One end of each of the corrugated portions 22 and 23 is connected to the corrugated portion 15.

As illustrated in FIG. 24, the heat transfer plate 3 includes a corrugated portion 24 and a corrugated portion 25 (fourth waves) formed on a side of the first outlet 10 and the second outlet 12, respectively. The ridges of the corrugated portion 24 and the corrugated portion 25 radially extend toward the corrugated portion 16 with respect to the first outlet 10 and the second outlet 12, respectively. One end of each of the corrugated portions 24 and 25 is connected to the corrugated portion 16.

In the corrugated portions 22 and 23 of the heat transfer plate 2 and the corrugated portions 24 and 25 of the heat transfer plate 3, the top parts of the corrugated portions 22 and 23 and the bottom parts of the corrugated portions 24 and 25 face each other, and the bottom parts of the corrugated portions 22 and 23 and the top parts of the corrugated portions 24 and 25 face each other.

The top parts and the bottom parts of the corrugated portions 22, 23, 24, and 25 each have a planar shape. The top width and the bottom width (width b') of the corrugated portions 23 and 25 illustrated in FIGS. 23 and 26 are larger than the top width and the bottom width (width b) of the corrugated portions 19 and 21 illustrated in FIGS. 11 and 16 ($b'>b$) and are smaller than the top width and the bottom width (width a) of the corrugated portions 15 and 16 illustrated in FIGS. 10 and 15 ($a>b'$). The top width and the bottom width (width c') of the corrugated portions 22 and 24 illustrated in FIGS. 22 and 25 are larger than the top width and the bottom width (width a) of the corrugated portions 15 and 16 illustrated in FIGS. 10 and 15 ($c'>a$). The width c is smaller than or equal to the width c'. That is, the relationship among the widths a, b, b', c, and c' is expressed as $c'c\geq a>b'>b$.

As described above, the smaller the top width and the bottom width, the larger the heat exchange area where the water and the refrigerant exchange heat therebetween. That is, the region including the corrugated portions 19 and 21 whose top width and bottom width each correspond to the width b has the largest heat exchange area. The heat exchange area becomes smaller in the following order: a region including the corrugated portions 23 and 25 whose top width and bottom width each correspond to the width b', the region including the corrugated portions 15 and 16 whose top width and bottom width each correspond to the width a, the region including the corrugated portions 18 and 20 whose top width and bottom width each correspond to the width c, and a region including the corrugated portions 22 and 24 whose top width and bottom width each correspond to the width c'.

Hence, if the water freezes in the plate heat exchanger 30, the water starts to freeze in the regions including the corrugated portions 19 and 21 and the corrugated portions 23 and 25. The freezing gradually proceeds from those regions toward the region including the corrugated portions 15 and 16, and lastly reaches the regions including the corrugated portions 18 and 20 and the corrugated portions 22 and 24.

If the water starts to freeze in the regions including the corrugated portions 19 and 21 and the corrugated portions 23 and 25, spaces that allow the water to expand are provided on the side toward the region including the corrugated portions 15 and 16. Then, if the water freezes in the region including the corrugated portions 15 and 16, spaces that allow the water to expand are provided on the respective sides toward the regions including the corrugated portions 18 and 20 and the corrugated portions 22 and 24. Lastly, if the water freezes in the regions including the corrugated portions 18 and 20 and the corrugated portions 22 and 24, spaces that allow the water to expand are provided in the first inlet 9 and the first outlet 10, respectively. Hence, if the water freezes in the above order, any spaces that allow the water to expand are always provided. Therefore, no force attributed to the expansion of the frozen water is applied in the stacking direction, and there is less chance that the heat transfer plates 2 and 3 may be disconnected from each other and the plate heat exchanger 30 may be damaged.

As described in Embodiment 1, in a normal case, the water starts to freeze near the first outlet 10 and the second outlet 12 that are on the downstream side, and the freezing gradually proceeds toward the first inlet 9 and the second inlet 11 that are on the upstream side. Hence, in the normal case, the water does not tend to freeze lastly in the closed region near the second outlet 12. Occasionally, however, the water may start to freeze at the first outlet 10, and the freezing may gradually proceed toward the second outlet 12. In such a case, no space that allows the water to expand is provided near the second outlet 12, and the plate heat exchanger 30 may be damaged.

In the plate heat exchanger 30 according to Embodiment 2, however, the water is prevented from freezing lastly not only in the closed region near the second inlet 11 but also in the closed region near the second outlet 12. Hence, the occurrence of damage to the plate heat exchanger 30 is more assuredly prevented than in Embodiment 1.

Embodiment 3

Embodiment 3 will now be described about a case where heat transfer plates of one kind are stacked such that the orientations thereof alternate. "The orientations thereof alternate" means that the orientations of adjacent ones of the heat transfer plates differ by 180 degrees such that the positions of the first inlet 9 and the second outlet 12 alternate.

A plate heat exchanger 30 according to Embodiment 3 basically has the same shape as the plate heat exchanger 30 according to Embodiment 2, except the relationship among the top widths and the bottom widths of the corrugated portions. Hence, only the relationship among the top widths and the bottom widths of the corrugated portions will be described herein.

Since heat transfer plates of one kind are stacked such that the orientations thereof alternate, the heat transfer plates 2 and 3 are of one kind, or the same plates. The orientations of the heat transfer plates 2 and 3 are only different.

Specifically, the corrugated portion 18 and the corrugated portion 23 have the same shape and are of the same size. That is, the top width and the bottom width (the width c in FIG. 12) of the corrugated portion 18 and the top width and the bottom width (the width b' in FIG. 23) of the corrugated portion 23 are the same (c=b'). The same applies to the corrugated portion 20 that faces the corrugated portion 18 and the corrugated portion 25 that faces the corrugated portion 23.

The corrugated portion 19 and the corrugated portion 22 have the same shape and are of the same size. That is, the top width and the bottom width (the width b in FIG. 11) of the corrugated portion 19 and the top width and the bottom width (the width c' in FIG. 22) of the corrugated portion 22 are the same (b=c'). The same applies to the corrugated portion 21 that faces the corrugated portion 19 and the corrugated portion 24 that faces the corrugated portion 22.

Hence, the top widths and the bottom widths of the corrugated portions 19, 21, 22, and 24 are made smaller than the top widths and the bottom widths of the corrugated portions 15, 16, 18, 20, 23, and 25. Furthermore, the top widths and the bottom widths of the corrugated portions 15, 16, 18, 20, 23, and 25 are made the same. That is, the relationship among the widths a, b, c, b', and c' is expressed as a=b'=c>b=c'.

As described above, the smaller the top width and the bottom width, the larger the heat exchange area where the water and the refrigerant exchange heat therebetween. That is, the regions including the corrugated portions 19 and 21 and the corrugated portions 22 and 24 whose top widths and bottom widths correspond to the width b and the width c', respectively, each have a large heat exchange area, whereas the regions including the corrugated portions 15 and 16, the corrugated portions 18 and 20, and the corrugated portions 23 and 25 whose top widths and bottom widths each correspond to the widths a, b', and c, respectively, each have a small heat exchange area.

Hence, if the water freezes in the plate heat exchanger 30, the water starts to freeze in the regions including the corrugated portions 22 and 24 and the corrugated portions 19 and 21. In the region including the corrugated portions 23 and 25, the water freezes in a relatively early stage because the region is on the downstream side. The freezing gradually proceeds from the above regions toward the region having the corrugated portions 15 and 16, and lastly reaches the region including the corrugated portions 18 and 20.

If the water starts to freeze in the regions including the corrugated portions 19 and 21 and the corrugated portions 22, and 24, spaces that allow the water to expand are provided on the side toward the region including the corrugated portions 15 and 16 and in some other regions. If the water freezes in the region including the corrugated portions 23 and 25, spaces that allow the water to expand are provided on the side toward the region including the corrugated portions 15 and 16 and in some other regions. Then, if the water freezes in the region including the corrugated portions 15 and 16, a space that allows the water to expand is provided on the side toward the region including the corrugated portions 18 and 20. Lastly, if the water freezes in the region including the corrugated portions 18 and 20, a space that allows the water to expand is provided in the first inlet 9. Hence, if the water freezes in the above order, any spaces that allow the water to expand are always provided. Therefore, no force attributed to the expansion of the frozen water is applied in the stacking direction, and there is less chance that the heat transfer plates 2 and 3 may be disconnected from each other and the plate heat exchanger 30 may be damaged.

As described above, in the plate heat exchanger 30 according to Embodiment 3, damage to the plate heat exchanger 30 that may occur if the fluid freezes in the plate heat exchanger 30 is prevented even in a case where heat transfer plates of one kind are stacked such that the orientations thereof alternate and the design flexibility is therefore low.

Embodiment 4

Embodiment 4 will now be described about an exemplary circuit configuration of a heat pump apparatus 100 including the plate heat exchanger 30.

In the heat pump apparatus 100, a refrigerant such as CO2, R410A, HC, or the like is used. Some refrigerants, such as CO2, have their supercritical ranges on the high-pressure side. Herein, an exemplary case where R410A is used as a refrigerant will be described.

Figure 27:
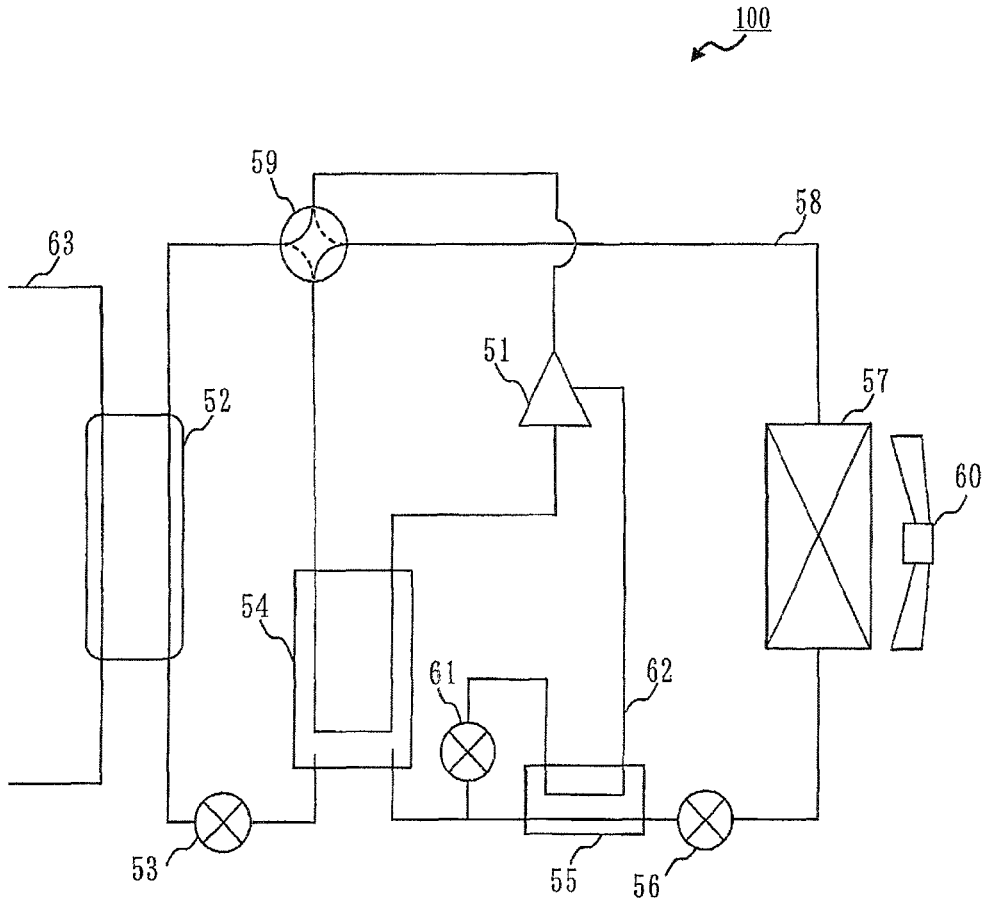
FIG. 27 is a circuit diagram of a heat pump apparatus 100 according to Embodiment 4.

FIG. 27 is a circuit diagram of the heat pump apparatus 100 according to Embodiment 4.

Figure 28:
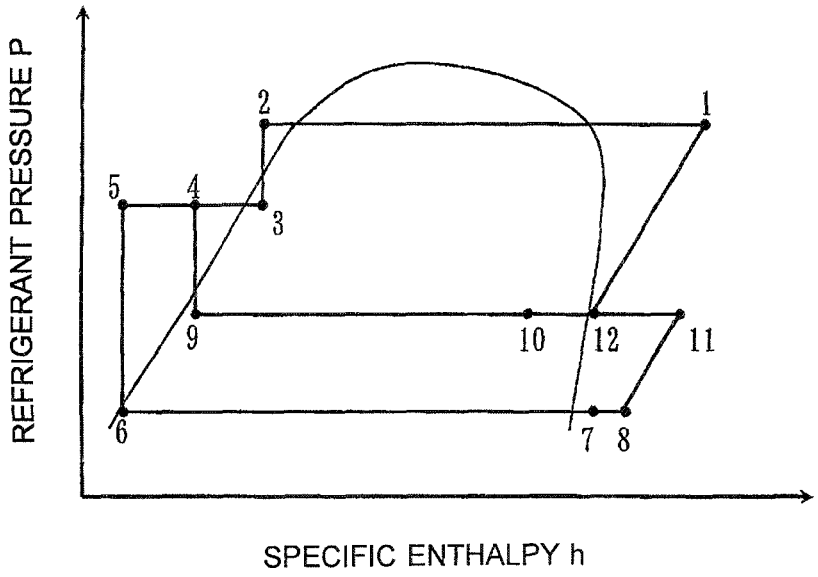
FIG. 28 is a Mollier chart illustrating the state of a refrigerant in the heat pump apparatus 100 illustrated in FIG. 27.

FIG. 28 is a Mollier chart illustrating the state of the refrigerant in the heat pump apparatus 100 illustrated in FIG. 27. In FIG. 28, the horizontal axis represents specific enthalpy, and the vertical axis represents refrigerant pressure.

The heat pump apparatus 100 includes a main refrigerant circuit 58 through which the refrigerant circulates. The main refrigerant circuit 58 includes a compressor 51, a heat exchanger 52, an expansion mechanism 53, a receiver 54, an internal heat exchanger 55, an expansion mechanism 56, and a heat exchanger 57 that are connected sequentially by pipes. In the main refrigerant circuit 58, a four-way valve 59 is provided on a discharge side of the compressor 51 and enables switching of the direction of refrigerant circulation. Furthermore, a fan 60 is provided near the heat exchanger 57. The heat exchanger 52 corresponds to the plate heat exchanger 30 according to any of Embodiments described above.

The heat pump apparatus 100 further includes an injection circuit 62 that connects a point between the receiver 54 and the internal heat exchanger 55 and an injection pipe of the compressor 51 by pipes. In the injection circuit 62, an expansion mechanism 61 and the internal heat exchanger 55 are sequentially connected.

The heat exchanger 52 is connected to a water circuit 63 through which water circulates. The water circuit 63 is connected to an apparatus that uses water, such as a water heater, a radiating apparatus as a radiator or for floor heating, or the like.

A heating operation performed by the heat pump apparatus 100 will first be described. In the heating operation, the four-way valve 59 is set as illustrated by the solid lines. The heating operation referred to herein includes heating for air conditioning and water heating for making hot water by giving heat to water.

A gas-phase refrigerant (point 1 in FIG. 28) having a high temperature and a high pressure in the compressor 51 is discharged from the compressor 51 and undergoes heat exchange in the heat exchanger 52 functioning as a condenser and a radiator, whereby the gas-phase refrigerant is liquefied (point 2 in FIG. 28). In this step, heat that has been transferred from the refrigerant heats the water circulating through the water circuit 63. The heated water is used for air heating or water heating.

The liquid-phase refrigerant obtained through the liquefaction in the heat exchanger 52 is subjected to pressure reduction in the expansion mechanism 53 and turns into a two-phase gas-liquid state (point 3 in FIG. 28). The two-phase gas-liquid refrigerant obtained in the expansion mechanism 53 exchanges heat, in the receiver 54, with a refrigerant that is sucked into the compressor 51, whereby the two-phase gas-liquid refrigerant is cooled and liquefied (point 4 in FIG. 28). The liquid-phase refrigerant obtained through the liquefaction in the receiver 54 splits and flows into the main refrigerant circuit 58 and the injection circuit 62.

The liquid-phase refrigerant flowing through the main refrigerant circuit 58 exchanges heat, in the internal heat exchanger 55, with a two-phase gas-liquid refrigerant obtained through the pressure reduction in the expansion mechanism 61 and flowing through the injection circuit 62, whereby the liquid-phase refrigerant is further cooled (point 5 in FIG. 28). The liquid-phase refrigerant having been cooled in the internal heat exchanger 55 is subjected to pressure reduction in the expansion mechanism 56 and turns into a two-phase gas-liquid state (point 6 in FIG. 28). The two-phase gas-liquid refrigerant obtained in the expansion mechanism 56 exchanges heat with the outside air in the heat exchanger 57 functioning as an evaporator and is thus heated (point 7 in FIG. 28). The refrigerant thus heated in the heat exchanger 57 is further heated in the receiver 54 (point 8 in FIG. 28) and is sucked into the compressor 51.

Meanwhile, as described above, the refrigerant flowing through the injection circuit 62 is subjected to pressure reduction in the expansion mechanism 61 (point 9 in FIG. 28) and undergoes heat exchange in the internal heat exchanger 55 (point 10 in FIG. 28). The two-phase gas-liquid refrigerant (an injection refrigerant) obtained through the heat exchange in the internal heat exchanger 55 remains in the two-phase gas-liquid state and flows through the injection pipe of the compressor 51 into the compressor 51.

In the compressor 51, the refrigerant (point 8 in FIG. 28) having been sucked from the main refrigerant circuit 58 is compressed to an intermediate pressure and is heated (point 11 in FIG. 28). The refrigerant having been compressed to an intermediate pressure and having been heated (point 11 in FIG. 28) merges with the injection refrigerant (point 10 in FIG. 28), whereby the temperature drops (point 12 in FIG. 28). The refrigerant having a dropped temperature (point 12 in FIG. 28) is further compressed and heated to have a high temperature and a high pressure, and is then discharged (point 1 in FIG. 28).

In a case where an injection operation is not performed, the opening degree of the expansion mechanism 61 is set fully closed. That is, in a case where the injection operation is performed, the opening degree of the expansion mechanism 61 is larger than a predetermined opening degree. In contrast, in the case where the injection operation is not performed, the opening degree of the expansion mechanism 61 is made smaller than the predetermined opening degree. This prevents the refrigerant from flowing into the injection pipe of the compressor 51.

The opening degree of the expansion mechanism 61 is electronically controlled by a controller such as a microcomputer.

A cooling operation performed by the heat pump apparatus 100 will now be described. In the cooling operation, the four-way valve 59 is set as illustrated by the broken lines. The cooling operation referred to herein includes cooling for air conditioning, cooling for making cold water by receiving heat from water, refrigeration, and the like.

A gas-phase refrigerant (point 1 in FIG. 28) having a high temperature and a high pressure in the compressor 51 is discharged from the compressor 51 and undergoes heat exchange in the heat exchanger 57 functioning as a condenser and a radiator, whereby the gas-phase refrigerant is liquefied (point 2 in FIG. 28). The liquid-phase refrigerant obtained through the liquefaction in the heat exchanger 57 is subjected to pressure reduction in the expansion mechanism 56 and turns into a two-phase gas-liquid state (point 3 in FIG. 28). The two-phase gas-liquid refrigerant obtained in the expansion mechanism 56 undergoes heat exchange in the internal heat exchanger 55, thereby being cooled and liquefied (point 4 in FIG. 28). In the internal heat exchanger 55, the two-phase gas-liquid refrigerant obtained in the expansion mechanism 56 and another two-phase gas-liquid refrigerant (point 9 in FIG. 28) obtained through the pressure reduction, in the expansion mechanism 61, of the liquid-phase refrigerant having been liquefied in the internal heat exchanger 55 exchange heat therebetween. The liquid-phase refrigerant (point 4 in FIG. 28) having undergone heat exchange in the internal heat exchanger 55 splits and flows into the main refrigerant circuit 58 and the injection circuit 62.

The liquid-phase refrigerant flowing through the main refrigerant circuit 58 exchanges heat, in the receiver 54, with the refrigerant that is sucked into the compressor 51, whereby the liquid-phase refrigerant is further cooled (point 5 in FIG. 28). The liquid-phase refrigerant having been cooled in the receiver 54 is subjected to pressure reduction in the expansion mechanism 53 and turns into a two-phase gas-liquid state (point 6 in FIG. 28). The two-phase gas-liquid refrigerant obtained in the expansion mechanism 53 undergoes heat exchange in the heat exchanger 52 functioning as an evaporator, and is thus heated (point 7 in FIG. 28). In this step, since the refrigerant receives heat, the water circulating through the water circuit 63 is cooled and is used for cooling or refrigeration.

The refrigerant having been heated in the heat exchanger 52 is further heated in the receiver 54 (point 8 in FIG. 28) and is sucked into the compressor 51.

Meanwhile, as described above, the refrigerant flowing through the injection circuit 62 is subjected to pressure reduction in the expansion mechanism 61 (point 9 in FIG. 28) and undergoes heat exchange in the internal heat exchanger 55 (point 10 in FIG. 28). The two-phase gas-liquid refrigerant (injection refrigerant) obtained through heat exchange in the internal heat exchanger 55 remains in the two-phase gas-liquid state and flows into the injection pipe of the compressor 51.

The compressing operation in the compressor 51 is the same as that for the heating operation.

In the case where the injection operation is not performed, the opening degree of the expansion mechanism 61 is set fully closed as in the case of the heating operation so that the refrigerant does not flow into the injection pipe of the compressor 51.

The invention claimed is:

1. A plate heat exchanger comprising:

first plates, each of which has a rectangular shape, and second plates, each of which has a rectangular shape, the first plates and the second plates being stacked alternately on one another and each being provided with passage holes at four corners thereof, the passage holes serving as inlets and outlets for a first fluid and a second fluid;

first passages, each of which is a passage through which the first fluid flows, and second passages, each of which is a passage through which the second fluid flows, the first passages and the second passages being formed alternately with one another between adjacent ones of the first plates and corresponding ones of the second plates in a stacking direction, wherein each of the first passages allows the first fluid having flowed therein from a first inlet to flow out of a first outlet, the first inlet being one of the passage holes that is on a first side in a long-side direction each of the first plates and each of the second plates, the first outlet being one of the passage holes that is on a second side in the long-side direction, the first passage including a heat-exchanging passage that extends between the first inlet and the first outlet and allows the first fluid to exchange heat with the second fluid flowing in a corresponding one of the second passages adjacent to the first passage, wherein each of the first plates includes, in the heat-exchanging passage thereof, first waves formed in a corrugated portion, protruding in the stacking direction and including a plurality of top parts and a plurality of bottom parts alternately formed in a repeated manner from the first inlet toward the first outlet, and second waves formed in a corrugated portion, protruding in the stacking direction and including a plurality of top parts continuously connected to the top parts of the first waves at a same height, the second waves being formed on a side of an upstream-side adjacent hole in the heat-exchanging passage, the upstream-side adjacent hole being another one of the passage holes that is on the first side in the long-side direction and is different from the first inlet, wherein the top parts of the first waves and the top parts of the second waves have respective planar shapes, and the top parts of the first waves have a larger top width than the top parts of the second waves, the top width being a width in a direction perpendicular to ridges of each corrugated portion, and an angle formed between each of the ridges of the second waves and a line parallel to the long-side direction is smaller than an angle formed between each of the ridges of the first waves and the line parallel to the long-side direction.

2. The plate heat exchanger of claim 1, wherein each of the first plates includes, on a side of the first inlet in the heat-exchanging passage, third waves formed in a corrugated portion, protruding in the stacking direction and including a plurality of top parts continuously connected to the top parts of the first waves, and wherein the top parts of the third waves have a planar shape; and the top parts of the third waves and the top parts of the first waves have a same top width, or the top parts of the third waves have a larger top width than the top parts of the first waves.

3. The plate heat exchanger of claim 1, wherein each of the first plates includes third waves formed in a corrugated portion, protruding in the stacking direction and including a plurality of top parts continuously connected to the top parts of the first waves, the third waves being formed on a side of a downstream-side adjacent hole in the heat-exchanging passage, the downstream-side adjacent hole being another one of the passage holes that is on the second side in the long-side direction and is different from the first outlet, and wherein the top parts of the third waves have a planar shape; the top parts of the third waves have a larger top width than the top parts of the second waves; and the top parts of the third waves and the top parts of the first waves have a same top width, or the top parts of the third waves have a smaller top width than the top parts of the first waves.

4. The plate heat exchanger of claim 1, wherein the second waves form a corrugated portion and ridges of the corrugated portion radially extend with respect to the upstream-side adjacent hole.

5. The plate heat exchanger of claim 2, wherein the third waves form a corrugated portion and ridges of the corrugated portion radially extend with respect to the first inlet.

6. The plate heat exchanger of claim 1, wherein the second passages allow the second fluid having flowed therein from the upstream-side adjacent hole to flow out of a downstream-side adjacent hole as another one of the passage holes that is on the second side in the long-side direction and is different from the first outlet.

7. The plate heat exchanger of claim 1, wherein each of the second plates includes a corrugated portion in which, when seen in the stacking direction, bottom parts of the corrugated portion face the top parts of the first waves and the second waves formed in a corresponding one of the first plates and top parts of the corrugated portion face the bottom parts of the first waves and the second waves of another corresponding one of the first plates.

8. The plate heat exchanger according to claim 1, wherein the second waves branch off from the first waves to extend towards the upstream-side adjacent hole.

9. The plate heat exchanger according to claim 1, wherein each of the plurality of top parts of the second waves that are continuously connected to the top parts of the first waves have a constant width.

10. A heat pump apparatus comprising a refrigerant circuit including, a compressor, a first heat exchanger, an expansion mechanism, and a second heat exchanger, the refrigerant circuit being formed by connecting the compressor, the first heat exchanger, the expansion mechanism, and the second heat exchanger with pipe, wherein the first heat exchanger that is connected in the refrigerant circuit includes, a plate heat exchanger, including first plates, each of which has a rectangular shape, and second plates each of which has a rectangular shape, the first plates and second plates being stacked alternately on one another and each being provided with passage holes at four corners thereof, the passage holes serving as inlets and outlets for a first fluid and a second fluid;

first passages, each of which is a passage through which the first fluid flows, and second passages, each of which is a passage through which the second fluid flows, the first passages and the second passages being formed alternately with one another between adjacent ones of the first plates and corresponding ones of the second plates in a stacking direction, wherein each of the first passages allows the first fluid having flowed therein from a first inlet to flow out of a first outlet, the first inlet being one of the passage holes that is on a first side in a long-side direction each of the first plates and each of the second plates, the first outlet being one of the passage holes that is on a second side in the long-side direction, the first passage including a heat-exchanging passage that extends between the first inlet and the first outlet and allows the first fluid to exchange heat with the second fluid flowing in a corresponding one of the second passages adjacent to the first passage, wherein each of the first plates includes, in the heat-exchanging passage thereof, first waves formed in a corrugated portion, protruding in the stacking direction and including a plurality of top parts and a plurality of bottom parts alternately formed in a repeated manner from the first inlet toward the first outlet, and second waves formed in a corrugated portion, protruding in the stacking direction and including a plurality of top parts continuously connected to the top parts of the first waves at a same height, the second waves being formed on a side of an upstream-side adjacent hole in the heat-exchanging passage, the upstream-side adjacent hole being another one of the passage holes that is on the first side in the long-side direction and is different from the first inlet, and wherein the top parts of the first waves and the top parts of the second waves have respective planar shapes, and the top parts of the first waves have a larger top width than the top parts of the second waves, the top width being a width in a direction perpendicular to ridges of each corrugated portion, an angle formed between each of the ridges of the second waves and a line parallel to the long-side direction is smaller than an angle formed between each of the ridges of the first waves and the line parallel to the long-side direction.

11. The heat pump apparatus according to claim 10, wherein the second waves branch off from the first waves to extend towards the upstream-side adjacent hole.

12. The heat pump apparatus according to claim 10, wherein each of the plurality of top parts of the second waves that are continuously connected to the top parts of the first waves have a constant width.

* * * * *